US005238240A

United States Patent [19]

Prim et al.

[11] Patent Number: 5,238,240

[45] Date of Patent: Aug. 24, 1993

[54] METHOD AND APPARATUS FOR QUICK CHANGE-OVER FROM EITHER A DUAL DELIVERY TRIMMER APPARATUS TO A SINGLE DELIVERY TRIMMER APPARATUS OR VICE VERSA

[75] Inventors: John E. Prim, West Chazy; David Hall, Plattsburgh, both of N.Y.

[73] Assignee: Prim Hall Enterprises Inc., Plattsburgh, N.Y.

[21] Appl. No.: 874,598

[22] Filed: Apr. 27, 1992

[51] Int. Cl.[5] ..... B65H 39/10

[52] U.S. Cl. ..... 271/299; 271/302; 271/198; 198/366; 198/369

[58] Field of Search ..... 271/278, 279, 280, 299, 271/302, 198; 198/458, 570, 366, 369, 836.1, 836.3

[56] References Cited

U.S. PATENT DOCUMENTS

| | | | |
|---|---|---|---|
| 1,741,616 | 12/1929 | Crady | 198/369 |
| 2,334,384 | 11/1943 | Cohen | 198/369 |
| 2,745,538 | 5/1956 | Lamb | 271/299 |
| 3,379,299 | 4/1968 | Griner | 198/570 |
| 3,860,232 | 1/1975 | Martin | 271/198 |
| 4,502,594 | 3/1985 | Sijbrandij | 198/836.3 |

*Primary Examiner*—H. Grant Skaggs

*Attorney, Agent, or Firm*—Louis Weinstein

[57] ABSTRACT

Conveyors for selectively conveying product delivered thereto either along a pair of side-by-side delivery lanes or a single delivery lane adjacent the pair of side-by-side lanes, the conveyors conveying product to output devices, such as stackers. One of the conveyors being laterally movable between a position aligned to receive product from one of the pair of lanes to a position displaced therefrom and displaced from the other one of the conveyors. The other one of the conveyors having an upstream section swingable about a pivot point to respectively align the upstream end of the swingable section either with the remaining one of the side-by-side lanes or with the single lane. Releasable clamping assemblies are released to provide movement of the conveyors and are clamped to retain the conveyors in the desired position. A drive coupler between one of the conveyors and the other of the conveyors may be selectively operated to either couple or decouple drive from the first-mentioned conveyor. Conveying belts are provided which belts adequately negotiate the curvatures of the conveyor paths to assure proper conveyance of product as well as to negotiate the curved conveying path created when the swingable section is moved to the position for receiving product from the single conveyor lane.

43 Claims, 10 Drawing Sheets

METHOD AND APPARATUS FOR QUICK CHANGE-OVER FROM EITHER A DUAL DELIVERY TRIMMER APPARATUS TO A SINGLE DELIVERY TRIMMER APPARATUS OR VICE VERSA

FIELD OF THE INVENTION

The present invention relates to method and apparatus for delivering either a dual stream from a five-knife mail table or trimmer or alternatively, from a single stream three-knife mail table or trimmer to associated stackers, and more particularly, to novel method and apparatus for effecting a quick change-over for delivery from a five-knife trimmer to a three-knife trimmer, or vice versa.

BACKGROUND OF THE INVENTION

Magazines of either of the saddle-stitched or flat-back bound type are typically produced either sequentially or in pairs. In either case, in the flat-back or saddle-stitched, the product is normally trimmed. The magazine can be produced singularly or in pairs and then trimmed in two pieces.

When two products are produced from what is typically referred to as a five-knife trimmer, as shown in FIG. 1, the two magazines 10 are joined together as shown preparatory to being trimmed. Initially, the five-knife trimmer trims the sides as shown at 1, 2 and 3, and thereafter cuts and trims the magazine 10 to form two independent magazines 12 and 14 by cutting and trimming at 4 and 5.

The three-knife trimmer is employed when only a single magazine is being produced and the single magazine 16, as shown in FIG. 1*b*, is trimmed at sides 1, 2, and 3 as shown by the three-knife trimmer.

Conventional systems stack product utilizing two conveyors, in which each conveyor transfers one of the two five-knife products to associated stackers, five-knife work also being typically referred to as "two-on". When the processing equipment is set up for operation in the three-knife mode or one lane, typically referred to as "one-on", the product is produced along the centerline of the trimmer and conveyor equipment must be shifted over into alignment with one of the lanes conveying product to its associated stacker. More specifically, the two conveyor lanes when operating in the "two-on" mode are arranged so that they are offset from the centerline of the trimmer when operating as a three-knife trimmer and one of these conveyor lanes must be shifted so as to-be in alignment with the centerline of the three-knife trimmer to operate in the "one-on" mode. This shifting operation is difficult to do due to the product and significantly limits the performance and output capacity of the equipment since existing systems must "walk" the three-knife product over to one of the two delivery lanes.

In addition to the above, conventional systems have typically been designed for the application of hard copy labels. With the advent of ink jet printers, conventional systems must be retrofitted to accommodate ink jets.

BRIEF DESCRIPTION OF THE INVENTION

The present invention overcomes the disadvantages of conventional systems and is characterized by a design which is comprised of a set of conveyors that are capable of being moved from the position for "two-on" operation to "one-on" operation so that one of the conveyors has its centerline aligned with the centerline of the one-on trimmer which totally eliminates apparatus for "walking over" the product.

The present invention is comprised of a pair of conveyors movable to a first position for respectively conveying the dual magazine flow from a five-knife trimmer to associated stackers and a second position to convey a single lane magazine flow from a three-knife trimmer.

In order to convert the conveyor arrangement for handling one-on production of signatures from a three-knife trimmer, one of the conveyors is displaced from its normal delivery position after loosening releasable locking handles which maintain said conveyor in the desired magazine receiving position. The remaining conveyor is swung through a small angle about a pivot hinge so that its input end is moved from a position in alignment with the associated lane normally receiving the product from a five-knife trimmer to a position in alignment with the centerline of the lane of product flow produced by a three-knife trimmer after loosening of the locking handles. The locking handles for both conveyors are then tightened to maintain their associated conveyors in the proper position. When converting from three-knife production to five-knife production, the movement of the conveyors is reversed. The system is thus simply and rapidly adjusted for either three-knife or five-knife delivery.

Means is also provided for releasably coupling drive power to the conveyor lane which is not used when operating in the "one-on" mode.

The conveyors utilized for delivery of products from the three-knife and five-knife trimmers utilize conveyor chain having a side flexing capability to accommodate a change in direction of the conveyor path and is thus easily capable of accommodating an angle of approximately three degrees without any alignment problems of the conveyed product.

The conveyor system is designed to accommodate an ink jet printer and significantly simplifies the unit when compared with conventional designs.

The conveyor system may be used in any application where it is desired to selectively convey either one lane or two side-by-side lanes of product.

OBJECTS OF THE INVENTION

It is, therefore, one object of the present invention to provide method and apparatus for adjusting dual conveyor means for accommodating product delivery from either a five-knife trimmer or a three-knife trimmer.

It is another object of the present invention to provide method and apparatus for adjusting dual conveyor means for accommodating product delivery from either a single delivery lane or two delivery lanes arranged side-by-side.

Still another object of the present invention is to provide novel method and apparatus for adjusting a pair of conveyors for selectively delivering product from either a five-knife trimmer or a three-knife trimmer including means for slidably displacing one of the conveyors and for swingably moving the other one of the conveyors into the appropriate position.

Still another object of the present invention is to provide novel method and apparatus for adjusting a pair of conveyors for selectively delivering product from either a five-knife trimmer or a three-knife trimmer including means for slidably displacing one of the conveyors and for swingably moving the other one of the conveyors into the appropriate position and further comprising locking means being selectively movable between a locking and unlocking position to facilitate simple and yet rapid changing of the conveyors to accommodate product from either a three-knife (i.e. one lane) or a five-knife (i.e. two lanes side-by-side).

BRIEF DESCRIPTION OF THE FIGURES

The above, as well as other objects of the invention, will become apparent when reading the accompanying description and drawings in which:

FIGS. 3*k* and 31 show top and end views respectively of a hinge assembly for swingably moving one of said chain conveyors as is employed in the arrangement shown in FIG. 2.

DETAILED DESCRIPTION OF THE INVENTION

Figure 1B:
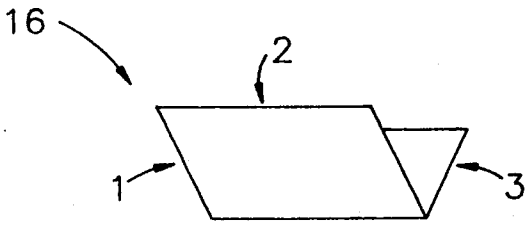
FIG. 1*b* is a simplified view showing the output from a three-knife trimmer.
Figure 1A:
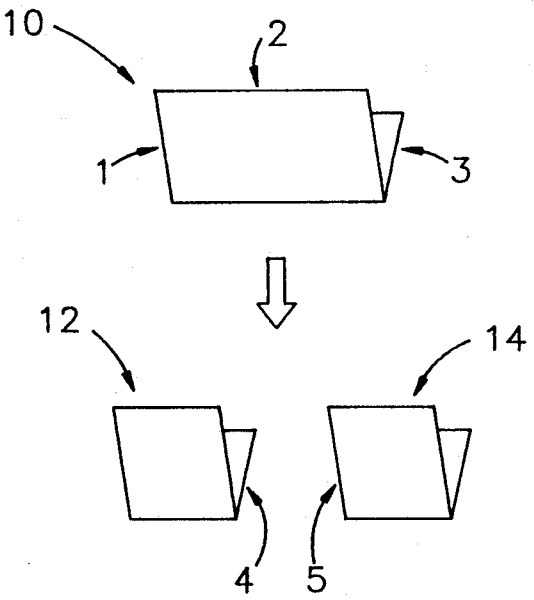
FIG. 1*a* is a simplified view showing the output from a five-knife trimmer.
Figure 2:
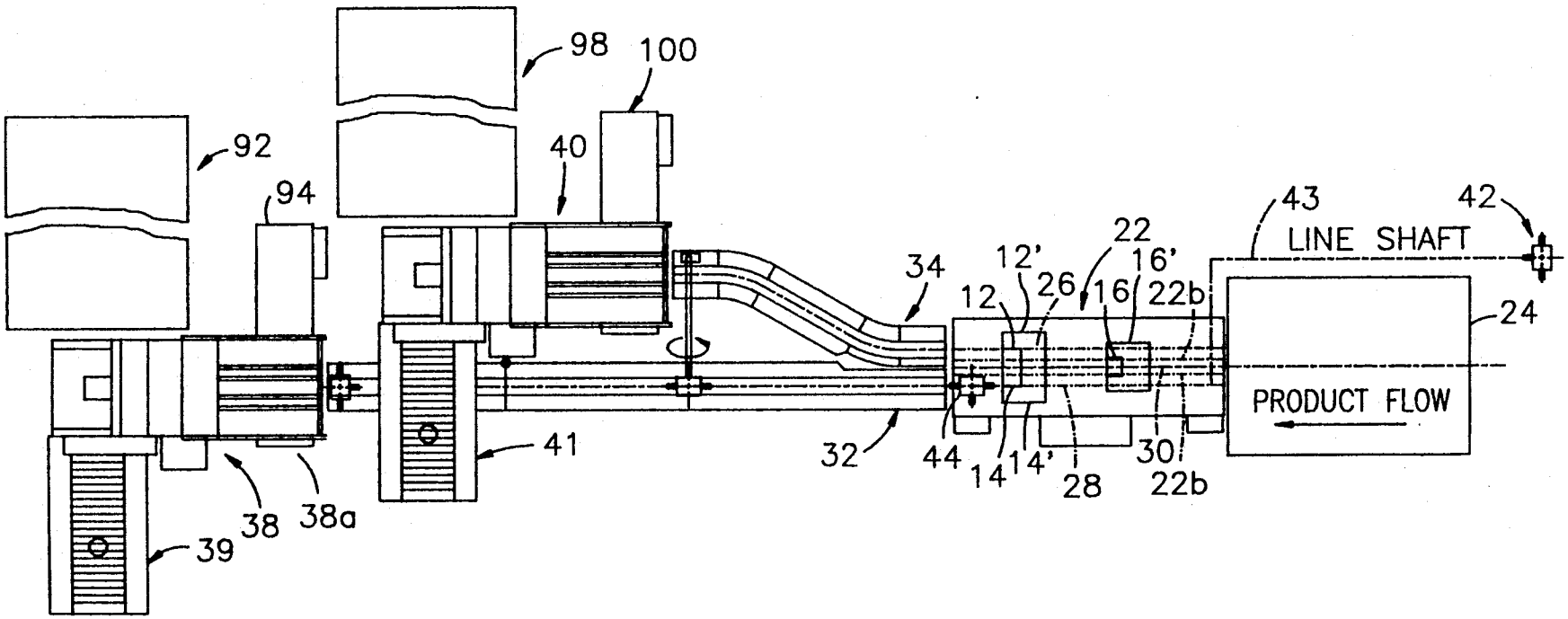
FIG. 2 shows a top plan view of a system employing the change-over conveyor arrangement of the present invention and showing the position for receiving product from a five-knife trimmer.
Figure 2A:
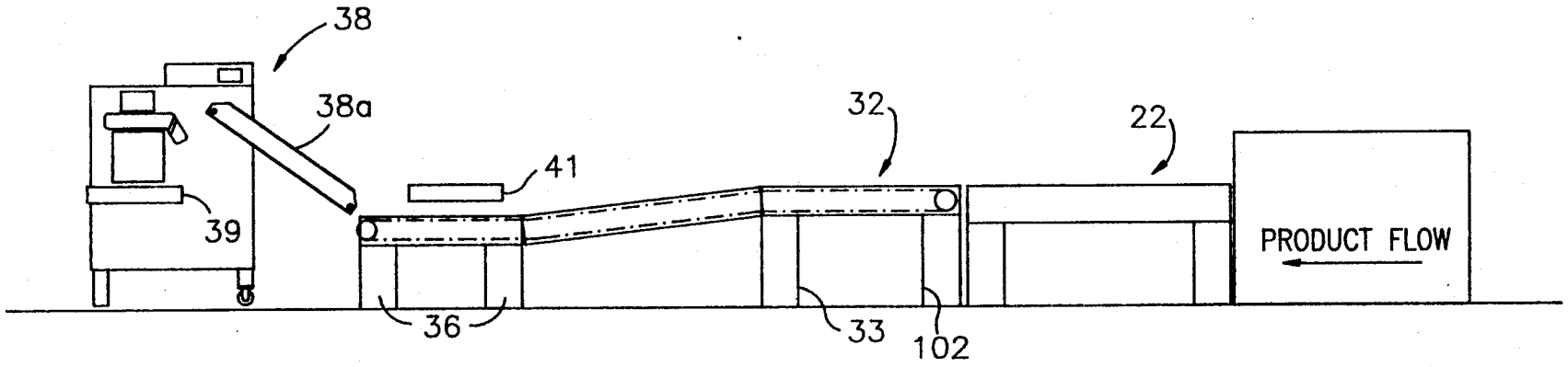
FIG. 2*a* shows an elevational view of the trimmer assembly and one of the conveyor lines of FIG. 2 and the stacker associated therewith.
Figure 2B:
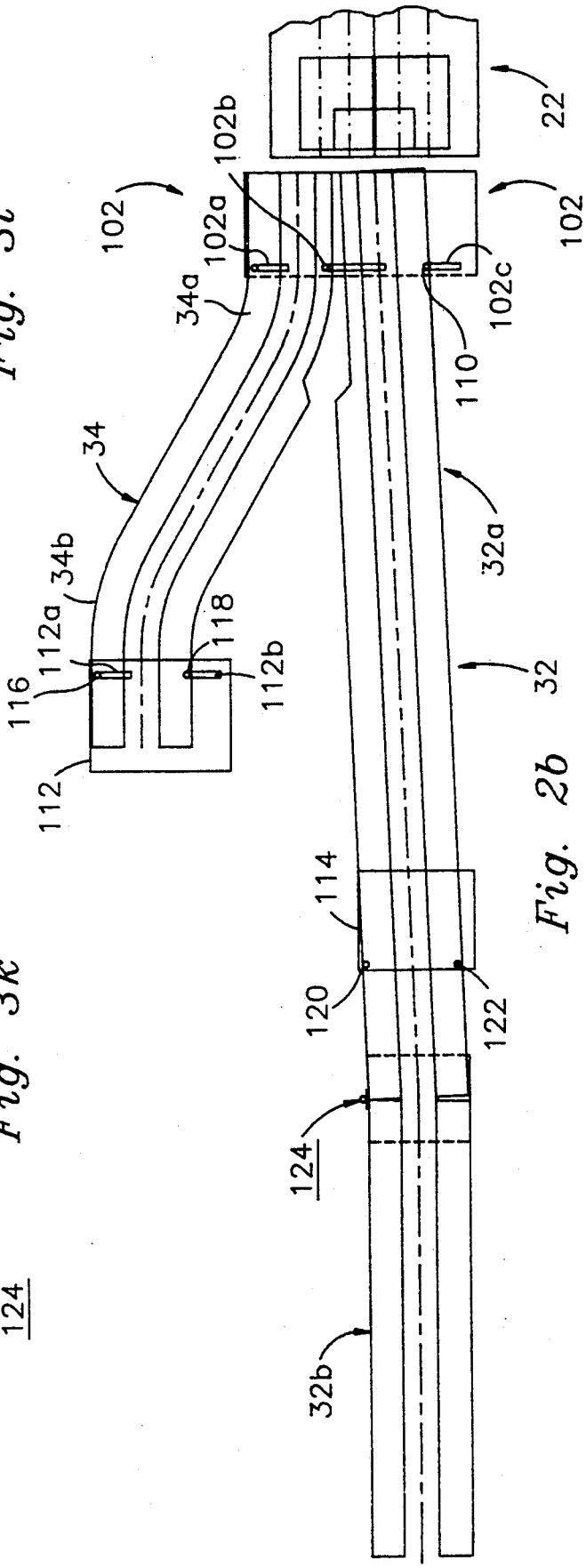
FIG. 2*b* is a simplified top plan view of the assembly of FIG. 2 with some of the elements being removed for purposes of simplicity and further showing the conveyors in position for conveying product from the three-knife trimmer.
Figure 2C:
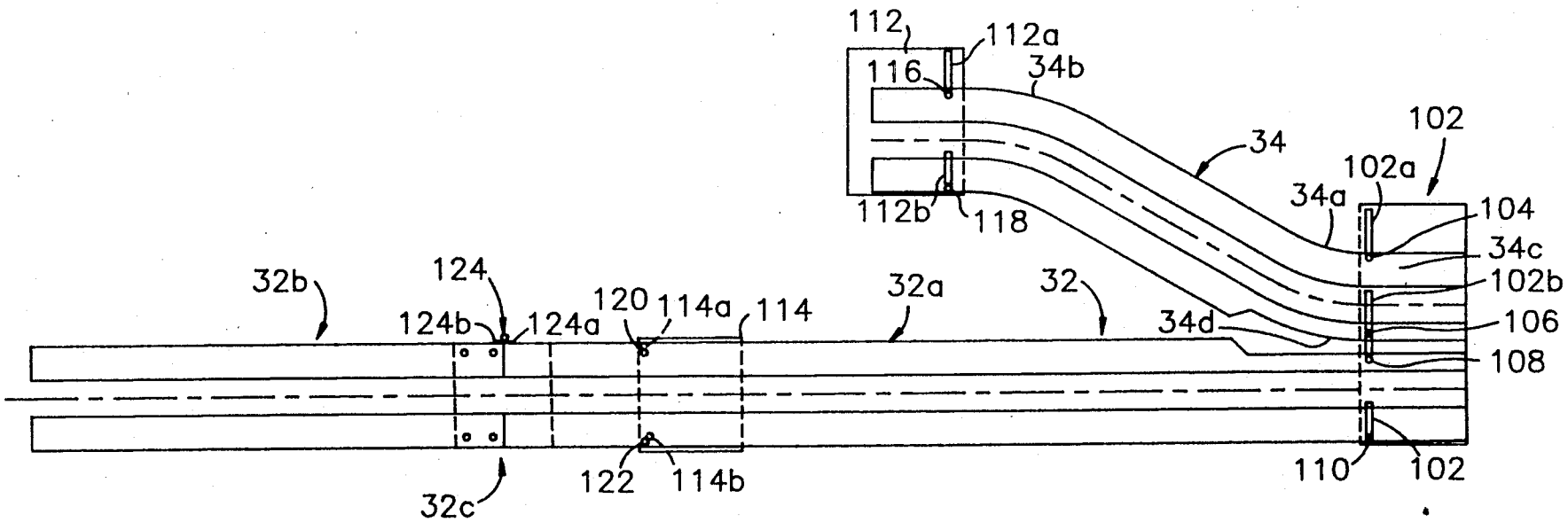
FIG. 2*c* is a simplified top plan view showing the conveyors in the position for receiving dual product from a five-knife trimmer.

FIGS. 2–2*c* show a system 20 designed in accordance with the principles of the present invention and which is comprised of a trimmer assembly including conveyor means 22, typically referred to as a "mail table", for conveying work from either a five-knife trimmer, such as trimmer 24, or a three-knife trimmer (not shown) for purposes of performing three-knife work. The three and five-knife trimmers may be Harris trimmers manufactured by AMI International. Any other trimmers may be used, if desired. As was disclosed hereinabove, the five-knife trimmer 24 trims a product in two stages such that product 10 is trimmed along the edges 1, 2 and 3 and subsequent thereto the product 10 is trimmed to form two separate products 12 and 14 whose opposing edges 4 and 5 are trimmed as shown. As was mentioned hereinabove, the system of the present invention is readily and easily converted for use with the three-knife trimmer to perform the trimming of the single product 16 along the edges 1, 2 and 3 as shown in FIG. 1*b*.

The product from the five-knife trimmer 24 is delivered to conveyor 22 and occupies the orientation as shown wherein the products 12 and 14 have the minimum product sizes of 5 inches by 5 inches and wherein the products 12′ and 14′ are the maximum product size of 9.3 inches by 11.5 inches.

When handling three-knife work, the minimum size 16 is 5 inches by 5 inches and the maximum size 16′ is 13 inches by 11.5 inches.

In the example given, the centerlines for products 12′ and 14′ are represented by dot-dash lines 26 and 28. The centerline for the three-knife product 16 or 16′ is 30. Belt conveyor means forming part of the conveyor 22 and not shown for purposes of simplicity, is of a width sufficient to convey product from either the three-knife work or five-knife work to the system conveyors 32 and 34 which, in FIG. 2 occupy the position for delivering five-knife work and are hereinafter also referred to as left and right lane conveyors respectively. The conveyor 32 is provided with legs or supports 33 to align the top surface of conveyor 32 with the conveyor 22. Legs 36 align the downstream end of conveyor 32 with a stacking apparatus 38 and also to provide sufficient clearance for an output delivery 41 for the stacker 40 associated with conveyor 34, to be more fully described. Dot-dash line 30 represents the centerline for three-knife work of any width within the limits as shown. Dot-dash lines 22*a*, 22*b* represent the centerlines of side-by-side five-knife products of minimum dimension and dot-dash lines 26, 28 represent the centerlines of side-by-side five-knife products of maximum size.

Figure 3L:
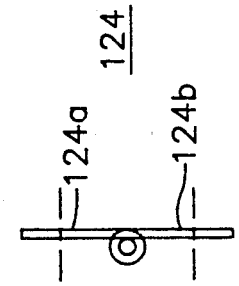
Figure 3K:
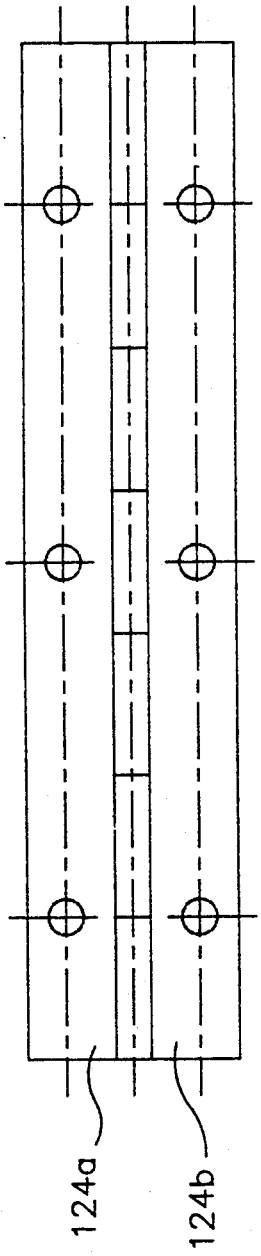
Figure 3A:
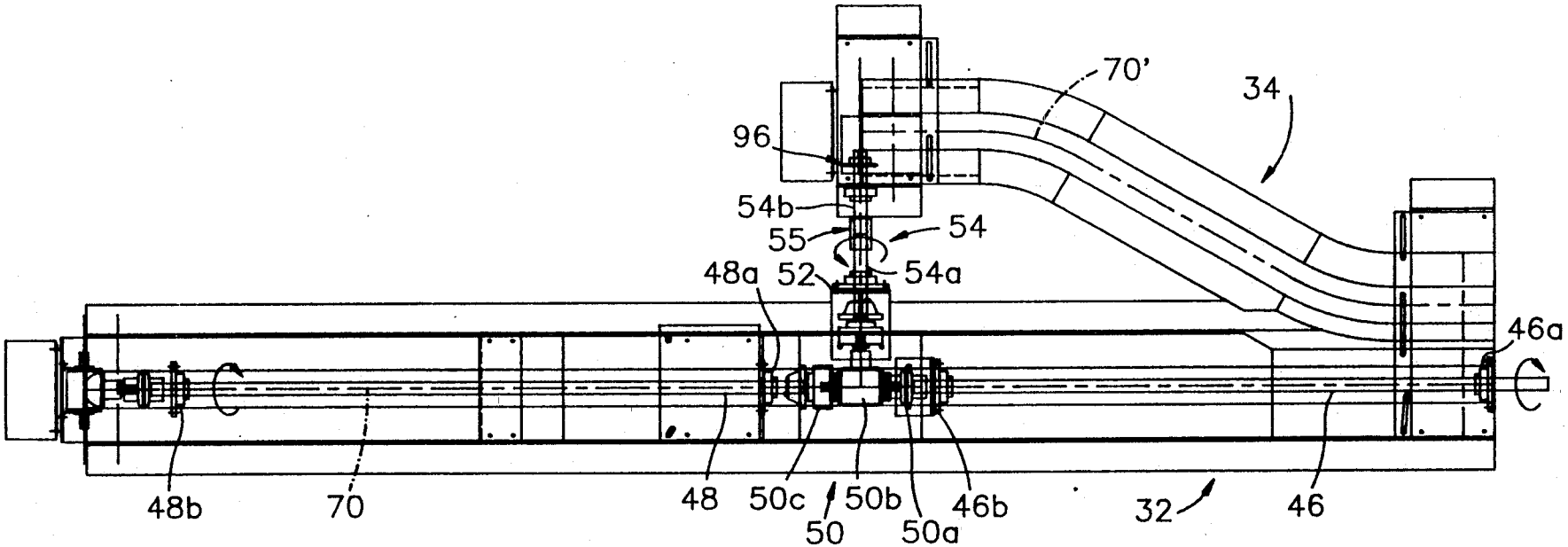
FIGS. 3*a* and 3*b* show top and elevational views respectively of the conveyors and further showing the drive and drive chains therefor.
Figures 3B, 3M, 3N, 3O:
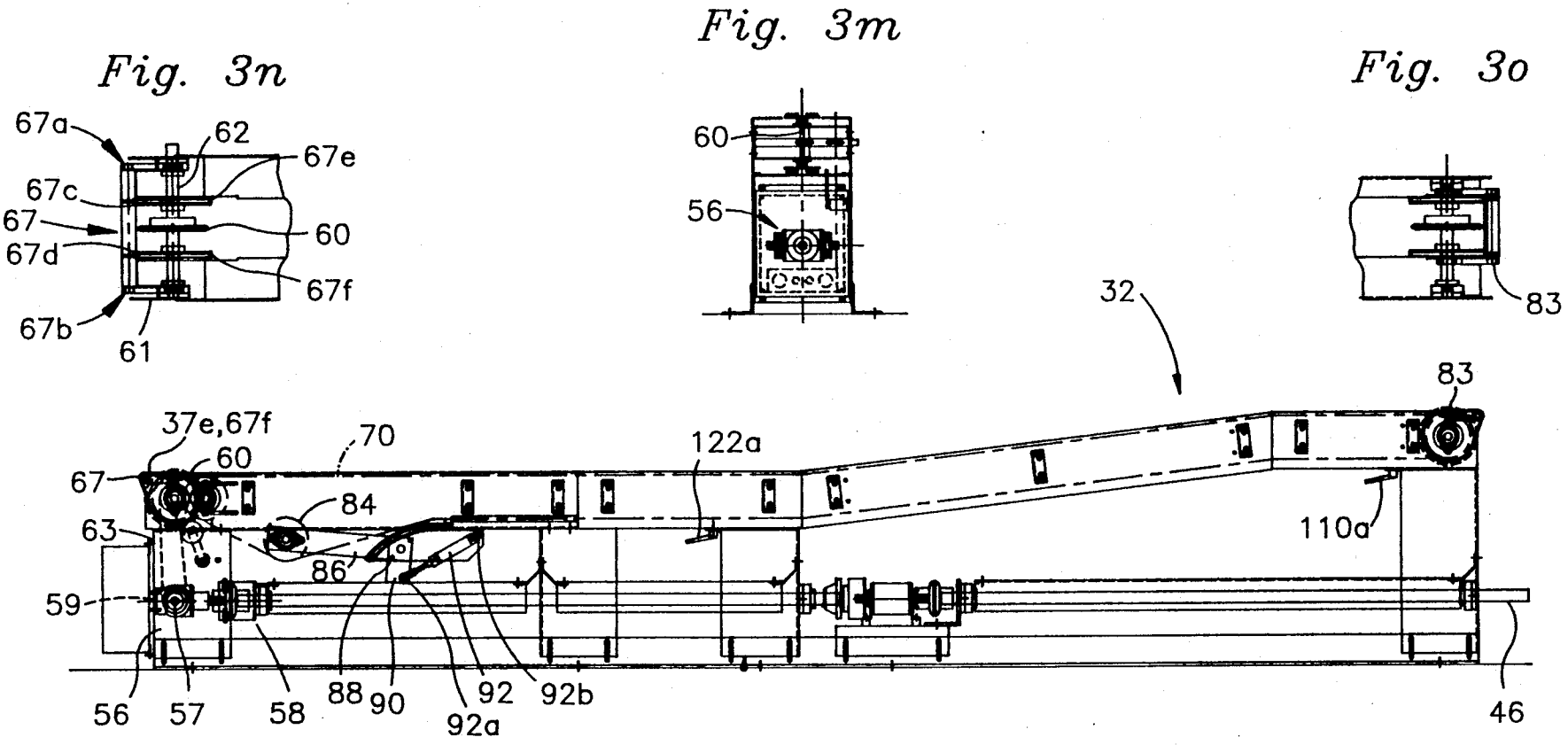
FIGS. 3*m*, 3*n* and 3*o* are end, partial top and partial top views of the downstream end and portions of the downstream and upstream ends of the conveyor shown in FIG. 3*b*.

Drive means, such as, for example, right-angle gear box which drives the three-knife or five-knife trimmer also drives the conveyor of conveyor table 22 through drive transmission means 44 (also a right-angle gear box) coupled to right-angle gear box 42 through a linear shaft 43. Right-angle gear box 44 is coupled with the upstream drive shaft 46 shown best in FIGS. 3*a*, 3*b*, 3*m*, 3*n* and 30 to synchronize the conveying speed of left and right lane conveyors 32 and 34 with that of the trimmer 24 and conveyor 22. The drive shaft 46 which is rotatably mounted by bearings 46*a*, 46*b* is coupled to a second downstream drive shaft 48 through coupling assembly 50 which further includes coupling 50*a*, right-angle gear box 50*b*, adjustable safety clutch 50*c* (which disengages shaft 48 from shaft 46 due to an output overload) and clutch means 52 for coupling to drive shaft 54 for driving conveyor 34. Drive shaft 54 is split into two shaft portions 54*a* 54*b* joined by coupling 55 which permits conveyors 32 and 34 to be moved independently by removing coupling 55. The output end of drive shaft 48, rotatably supported by bearings 48*a*, 48*b*, is coupled to right-angle gear box 56 through coupling 58 for coupling drive to the drive sprocket 60 mounted on shaft 62. Drive is coupled through shaft 57 of gear box 56 and sprocket 59 which couples drive to sprocket 61 through drive chain 63. The conveyor belt assembly is shown best in FIGS. 3*c* through 3*f* and is comprised of a support bracket 64 having upper and lower flanges 64*a*, 64*b* for supporting block-shaped guide members 66 to flanges 64*a* and 64*b* by fastening assemblies 68. The sprocket chain assembly 70 is driven by sprocket 60 and snap-fittingly receives a plurality of top plate assemblies 72 each of which is provided with a top member 72*a* having integral, spaced apart arms 72*b*, 72*c* which extend downwardly and are integrally joined to outwardly directed flanges 72*d*, 72*e* forming a pair of channels for guidance by associated guide blocks 66, 66 shown in FIG. 3*c*. The top plates are snap-fitted to the sprocket as shown best in FIG. 3*h*. The top plates are restrained from movement away from blocks 66 and are freely slidable along the closed-loop conveyor path. As shown in FIG. 3*d*, at intervals of fifteen inches, for example, there are arranged between the top plates, pusher flight members 72' which are substantially identical to the top plates 72 except for the addition of pusher blocks 72*f*, 72*g* mounted upon the top surface of the pusher flight members 72' which serve to assure positive advancement of product along the associated conveyor. Both conveyors 32 and 34 are provided with a similar arrangement.

An elongated roller 67 (FIGS. 3*b* and 3*n*) supported by brackets 67*a*, 67*b* receives two belts 67*c*, 67*d* entrained about roller 67 and large diameter rollers 67*e*, 67*f* respectively to maintain product leaving conveyor 70 horizontal as product moves past sprocket 60 to assure that product is at the proper height for entry upon the upstream end of the input conveyor 38*a* of stacker 38.

Figure 2D:
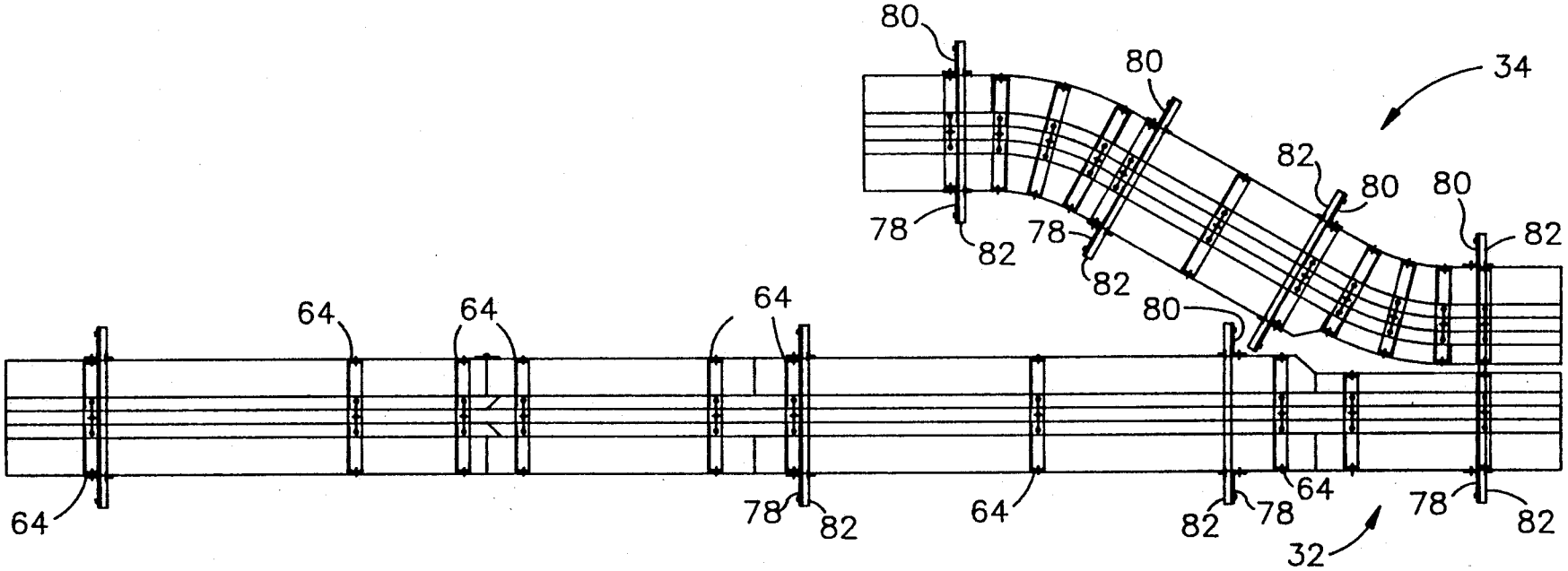
FIG. 2*d* is a top plan view of the conveyors of FIG. 2*c* showing the support brackets for the side guides which guide product moving along the conveyors.
Figure 3C:
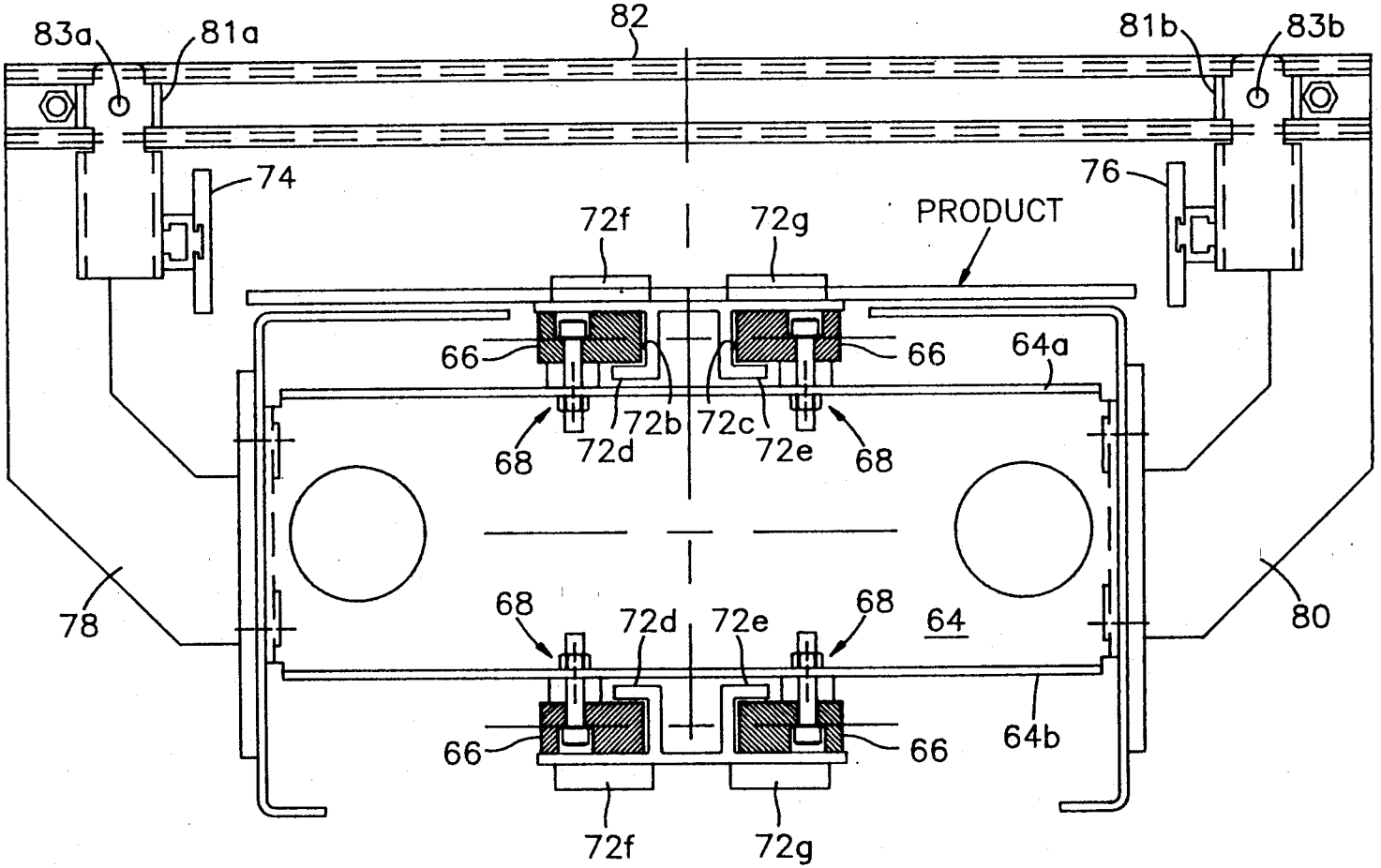
FIG. 3*c* shows a typical cross-section of the conveyor.
Figure 3E:
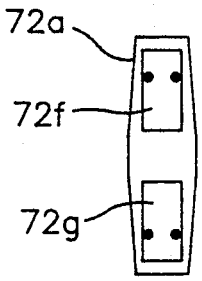
FIGS. 3*e*, 3*f* and 3*g* show top, side and bottom plan views of a typical pusher flight assembly employed in the typical pusher chain assembly of FIG. 3*d*.
Figure 3F:
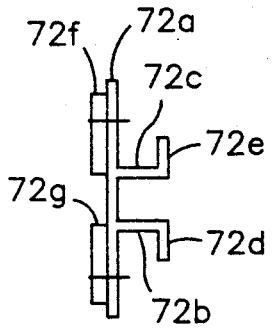
Figure 3G:
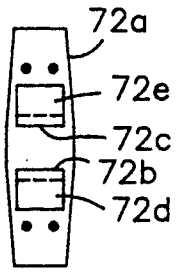
Figure 3D:
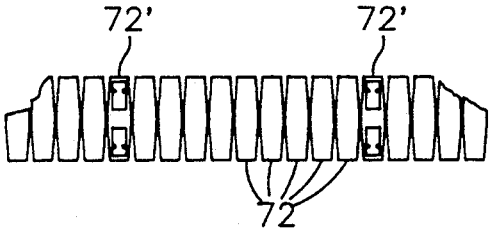
FIG. 3*d* shows a top plan view of a typical pusher chain assembly.

The conveyor is further provided with thin, flexible, plastic side guides 74, 76 extending the entire length of the conveyor as shown in FIGS. 2*d* and 3*c*. Brackets 81*a*, 82*a* slidable within channel 82, support the guides 74, 76 at their lower ends. Channel 82 is supported by brackets 78, 80 secured to the conveyor frame at spaced intervals, as shown, see FIG. 2*d*. Channel 82 is provided with Kipp handle assemblies 83*a*, 83*b* to releasably clamp brackets 81*a*, 81*b* into proper position. The flexible side guides form smooth curves and limit sidewise movement of product over the entire length of each conveyor 32 and 34.

Figure 3H:
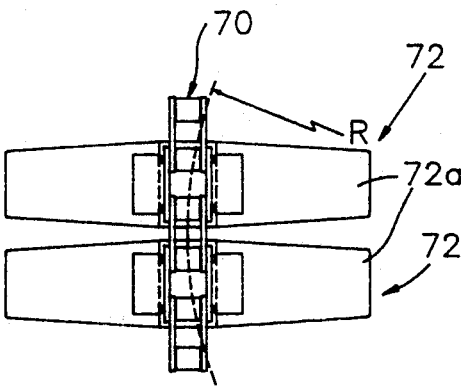
FIGS. 3*h*, 3*i* and 3*j* show detailed bottom, side and end views of the chain of FIGS. 3*e*–3*g*.
Figure 3J:
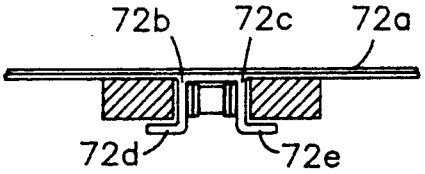
Figure 3I:
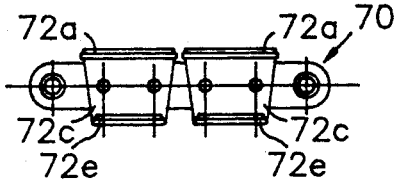

The dot-dash line 70 in FIG. 3*a* represents the chain assembly 70, a portion of which is shown, for example, in FIGS. 3*d*, 3*h* and 3*i* and which is arranged in a closed loop and extends about sprocket 60 at the downstream end of conveyor 32, a sprocket 83 at the upstream end of conveyor 32 and a tensioning sprocket 84 pivotally mounted upon the left-hand end of a swingably mounted bracket 86 which is pivoted about pin 88 extending through vertical support 90. An air or gas spring assembly 92 pivoted to bracket 90 at 92*a* and at arm 86 at 92*b*, urges arm 86 clockwise about pivot 88 to maintain the proper tension for chain 70. A similar arrangement may be provided for conveyor 34.

The product moves along the conveyor 32 and, upon reaching the downstream end thereof, is transferred to the infeed conveyor 38*a* of a stacker 38 which may be any suitable stacker for stacking the product of a three or five-knife trimmer, such as, for example, a RIMA Model RS12 stacker. The particular type of stacker contributes no novelty to the present invention and any stacker having capabilities similar to the type described may be utilized with equal success. The stacked product is preferably delivered to a shrink-wrap device 92 which may be any suitable shrink-wrap device capable of providing a shrink-wrap cover for the product which has been stacked and counted.

A reject conveyor 94 conveys product which has not met standards to an outfeed location. Defective product is manually directed to the reject conveyor.

As an alternative to shrink-wrapping the product, the product may be delivered by alternate conveyor 39 to another output location.

The right lane conveyor 34, as shown in FIGS. 2 and 3*a* is provided with a similar conveyor assembly, wherein the conveyor chain 70' is moved in a manner similar to the chain 70, a driven sprocket (not shown) being provided at the upstream end in a manner similar to the driven sprocket 83 of the left a manner similar to that described with reference to conveyor 32. The side guides 74', 76' are similar to those described for use on conveyor 32.

The right lane conveyor 34 is provided with a right-angle gear box (not shown) arranged near floor level and coupled to shaft 54. A sprocket chain similar to chain 63 (FIG. 3*b*) couples drive from the right-angle gear box near floor level to a sprocket 96 arranged at the height of the conveyor sprocket in a manner similar to sprocket 61 of FIG. 3*b* which chain, by removal, selectively decouples drive from conveyor 32 to conveyor 34 preparatory to receiving three-knife work. Right lane conveyor 34 is provided with two curved sections 34*a* and 34*b* in order to deliver a product to stacker 40, which is preferably of the same type as stacker 38, and to provide adequate clearance for the stacker device as can best be appreciated from a consideration of FIG. 2. Stacker 40 may either deliver a counted and stacked product to shrink-wrap 98 or alternatively to delivery conveyor 41 and is likewise provided with a reject conveyor 100. The guide blocks 66 assure that the top plates 72 and 72' and chain 70' follow the desired curves and inclines of the conveyor path. The chain 70, (as well as chain 70) is capable of sidewise flexing to follow the curves of the conveying path. The top flights taper from the middle portion toward the opposite ends thereof as shown in FIG. 3*h* to enable the top flight members to follow the curved path portions. A suitable chain and flights which may be employed in the present invention is the 41873 Series chain produced by Rexnord.

Considering FIGS. 2 and 2*c*, the upstream ends of the right and left lane conveyors 34 and 32 are movable relative to an upstream support frame 102. Support frame 102 is provided with a plurality of elongated slots 102*a*, 102*b* and 102*c* which slidably receive an elongated pin (or pins).

More specifically, the frame of the right lane conveyor 34 is provided with openings 34*c*, 34*d* which receive pins 104, 106, respectively. The pins are provided with heads to prevent the pins from passing through openings 104 and 106 and are preferably flush heads to avoid interference with the conveyance of product. The pins further respectively extend through elongated slots 102*a* and 102*b* and their bottom ends are coupled to releasable clamping means such as Kipp handles, for example, the Kipp handle 110*a* shown in FIG. 3*b*. The Kipp handles are swingable between a first position in which the Kipp handle draws the pin downwardly to effectively clamp the conveyor frame 34 to the upstream frame 102, and a second position where the clamping force is released. It should be understood that each of the Kipp handle assemblies, to be described hereinbelow, operate in substantially the identical fashion.

Right lane conveyor 34 is further supported by a downstream support frame 112 having elongated slots 112*a*, 112*b*. Pins 116 and 118 extend through openings in the supporting frame of right lane conveyor 34 and are slidably received by elongated slots 112*a*, 112*b* and have their bottom ends coupled to Kipp handle assemblies (not shown) similar to assembly 110*a*, for example. A similar conveyor support frame 114 is provided for left lane conveyor 32 at a location substantially intermediate the upstream and downstream ends of conveyor 32.

Left lane conveyor 32 is split into two portions, namely, an upstream portion 32*a* and a downstream portion 32*b*. The split is shown at 32*c* with the upstream and downstream portions being connected by hinge assembly 124 shown in detail in FIGS. 3*k* and 31. The mounting portions 124*a* and 124*b* of hinge assembly 124 are rigidly secured to the upstream and downstream frame portions 32*a*, 32*b* by suitable fasteners in the manner shown in FIG. 2*c*.

The set-up of the present invention for handling the output from either a three-knife or five-knife trimmer is as follows:

FIGS. 2 and 2*c* show the arrangement utilized for receiving a product from a five-knife trimmer. The centerlines of the upstream ends of left lane and right lane conveyors 32 and 34 are in alignment with the centerline of the left and right lanes of conveyed products 12' and 14' produced by the five-knife trimmer. The products are conveyed by the left and right lane conveyors 32 and 34 to 35 the stackers 38 and 40, the pusher members 72' of each conveyor assuring positive conveyance of product to each of the stackers.

In the event that it is desired to convert the system to deliver three-knife work, all of the Kipp handles are loosened; and the right lane conveyor 34 is moved from the position shown in FIG. 2*c* to the position shown in FIG. 2*b* whereupon the pins 104, 106, 116 and 118 are moved to the upper ends of elongated slots 102*a*, 102*b*, 112*a* and 112*b*. The Kipp handles are tightened to maintain the right lane conveyor 34 in the position shown in FIG. 2*d*, providing sufficient clearance for subsequent positioning of conveyor section 32*a* to receive product from a three-knife trimmer. The drive idler 96 shown in FIG. 3*a* is released and can be simply removed by hand. If desired, any other suitable releasable coupling means may be substituted for removable idler 9*b*.

The Kipp handles for the pins 108, 110, 120 and 122 are similarly loosened, conveyor section 32*a* is pivoted about the center pin of hinge 24 and is oriented at an angle of less than three degrees (more particularly, about 2.39 degrees) to align the upstream end of the centerline of the downstream end of the conveyor assembly 22. The length of conveyor section 32*a* is sufficient to assure that the angle formed between the centerlines of sections 32*a* and 32*b* is small and the curve formed in the conveyor path in the region of hinge 124 can be easily accommodated by chain 70 and top flight members 72 and 72, The Kipp handles associated with pins 108, 110, 120 and 122 are then tightened to maintain the left lane conveyor 32 in proper alignment.

The side flexing capability of the conveyor chain 70 is such that it accommodates the approximate three degree angle without a problem. The conveyor construction is sheet metal welded throughout the turns and elevation changes. UHMW wear strips 66 are used to guide the chains and the mechanical drive is taken from the trimmer which assures proper synchronism of the system.

In order to convert from a three-knife trimmer set-up to a five-knife trimmer set-up, the operation is simply the reverse of that described hereinabove wherein the Kipp handles for the left and right lane conveyors are loosened, the conveyors are realigned from the position shown in FIG. 2*b* to the position shown in FIG. 2*c*, the drive idler 96 for the right lane conveyor is replaced, the Kipp handles are all tightened down to maintain the left and right lane conveyors in the proper alignment and conveyance and stacking a product may then begin.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein described.

What is claimed is:

1. Conveyor apparatus for conveying product produced from either a three-knife trimmer or a five-knife trimmer to output utilization means, said conveyor system comprising:

left and right lane conveyor assemblies each having an upstream and a downstream end for conveying product;

support means for adjustably supporting the upstream ends of said left and right lane conveyors;

second support means for adjustably supporting the downstream end of said right lane conveyor;

said left lane conveyor being comprised of first and second conveyor sections arranged substantially end-to-end;

the upstream end of said first conveyor section being the upstream end of said right lane conveyor;

the downstream end of said first conveyor section being arranged adjacent the upstream end of said second conveyor section and the downstream end of said second conveyor section being arranged to convey product to said output utilization means;

the downstream end of said first section being hingedly connected to the upstream end of said second section to swingably adjust the upstream end of said first section to respectively receive product conveyed from one of the two delivery lanes of a five-knife trimmer when in the first position and product conveyed from a single delivery lane of a three knife trimmer when in the second position;

the right lane conveyor being movable upon said first and second support means between a first position for receiving product from the remaining one of the two delivery lanes of a five-knife trimmer to a second position displaced from said first position and from said left lane conveyor to provide sufficient clearance to enable proper positioning of said left lane conveyor relative to the product delivery lane of a three-knife trimmer.

2. The conveyor apparatus of claim 1 further comprising a conveyor table positioned adjacent the upstream ends of said left and right conveyors and having delivery conveyor means for delivering either one lane of product conveyed to said delivery conveyor means by a three-knife trimmer or first and second lanes of product arranged side-by-side delivered thereto by a five-knife trimmer.

3. The apparatus of claim 2 wherein the upstream ends of said left and right conveyors are aligned so that their centerlines are in alignment with the centerlines of the left and right lanes of product delivered by said delivery means when in their first position so that the centerline of said right lane conveyor is aligned with the centerline of a single lane of product provided from a three-knife trimmer and so that the left lane conveyor is displaced from the second position of said right conveyors are in their second position.

4. The apparatus of claim 3 wherein the centerline of the first conveyor section occupies first and second end locations when said first conveyor section upstream end is respectively moved to said first and second positions, the distance between said end locations being of the order of five inches.

5. The apparatus of claim 1 wherein the centerline of the first and second conveyor sections making up said left lane conveyor have imaginary centerlines which are in alignment when said first section is in its first position and wherein said imaginary centerlines form an acute angle when said first section is in said second position.

6. The apparatus of claim 5 wherein the length of said first section is selected to assure that the acute angle traversed by said first section is sufficiently small so that the conveyor portions traversing the first and second sections of said right lane conveyor does not cause misalignment of product conveyed therealong.

7. The apparatus of claim 6 wherein the angle between the centerlines when said first section is in said second position is less than five degrees.

8. The apparatus of claim 7 wherein said angle is preferably no greater than three degrees.

9. The apparatus of claim 8 wherein the angle is of the order of 2.4 degrees.

10. The apparatus of claim 1 wherein the first and second sections of said right lane conveyor are linear sections and said right lane conveyor is a curved conveyor having a substantially Z-shaped conveyor path;

the length of said left lane conveyor being greater than the length of said right lane conveyor to displace the downstream ends of said left and right lane conveyors from one another whereby stacking apparatus is arranged to receive product from the downstream end of said left and right lane conveyors without obstruction.

11. The apparatus of claim 10 wherein said right lane conveyor is comprised of a linear intermediate section and linear upstream and downstream sections;

a first curved section being arranged between said upstream section and said intermediate section and a second curved section being arranged between said linear intermediate section and said linear downstream section, to thereby form a continuous conveyor traversing said substantially Z-shaped conveyor path.

12. The apparatus of claim 10 wherein the Z-shaped configuration of said right lane conveyor displaces the downstream end of said right lane conveyor a predetermined distance from an adjacent side of said left lane conveyor to provide adequate room for positioning the stacker associated with said right lane conveyor enabling the left and right lane conveyors and their associated stackers to operate without obstruction.

13. The conveyor apparatus of claim 10 wherein at least said right lane conveyor is provided with side guides arranged in spaced substantially parallel fashion to guide product along said Z-shaped path.

14. The conveyor apparatus of claim 13 further comprising means for adjustably supporting said side guides at spaced intervals along said Z-shaped conveyor path to adjust the spacing between said side guides.

15. The conveyor apparatus of claim 14 wherein said adjustable supporting means further comprises releasably clamping means for clamping said side guides in the desired position.

16. The conveyor apparatus of claim 10 wherein both said left lane and right lane conveyors are provided with side guides arranged in spaced substantially parallel fashion to guide product along the path of said conveyors.

17. The apparatus of claim 1 further comprising third support means for slidably supporting the first section of said left lane conveyor at a location near the downstream end thereof.

18. The apparatus of claim 17 wherein said third support means is provided with elongated slots;

releasable clamping means cooperating with said third support means and extending through openings near the downstream end of the first section of said left lane conveyor and through said elongated slots, said elongated slots guiding said limiting the movement of the downstream end of the first section of said left lane conveyor.

19. The apparatus of claim 1 further comprising releasable clamping means for clamping the upstream ends of said left and right lane conveyors to said first supporting means in one of their respective first and second positions and being releasable to enable movement of the upstream ends of said right and left lane conveyors between their respective first and second positions.

20. The apparatus of claim 19 wherein said releasable clamping means comprise Kipp handle assemblies.

21. The apparatus of claim 1 wherein said first supporting means is provided with a plurality of elongated slots;

releasable clamping means extending through openings provided in the upstream ends of said left and right lane conveyors and through said elongated slots whereby the elongated slots guide the movement of the upstream ends of said left and right lane conveyors between their respective first and second positions.

22. The apparatus of claim 1 wherein said second support means is provided with a plurality of elongated slots;

releasable clamping means being provided for the downstream ends of said right lane conveyor and extending through openings provided in the downstream end of said right lane conveyor and through said elongated slots, said elongated slots guiding the movement of the downstream end of said right lane conveyor between its first and second positions.

23. The apparatus of claim 1 wherein said left and right lane conveyors are comprised of closed-loop conveyor means;

means for driving said left and right lane closed-loop conveyor means at a conveying speed responsive to the conveying speed of the delivery table delivering either three-knife or five-knife product to said conveying means.

24. The apparatus of claim 23 wherein said right lane conveyor means is driven by means coupled to said left lane conveyor means.

25. The apparatus of claim 24 wherein said means for coupling drive to said right lane conveyor means from said left lane conveyor means further comprises means for disengaging the closed-loop conveyor means of said right lane conveyor from the drive means of said left lane conveyor when said right lane conveyor is not receiving product.

26. The apparatus of claim 24 wherein said means for coupling drive to said right lane conveyor means from said left lane conveyor means further comprises means for disengaging the closed-loop conveyor means of said right lane conveyor from the drive means of said left lane conveyor when said left lane conveyor is moved to its second position.

27. The apparatus of claim 26 wherein said means disengaging comprises a chain coupled between output drive means of said left lane conveyor to drive means for said right lane conveyor, said chain being selectively removable.

28. The apparatus of claim 23 wherein each of said closed-loop conveyor means is comprised of a closed-loop drive chain having sufficient sidewise flexibility to enable said drive chain to accommodate the change in direction of the drive chain about curvatures in the conveying path including the region of said hinge means without effecting alignment of product conveyed therealong.

29. The apparatus of claim 28 wherein said drive chain is provided with top flight members coupled thereto and arranged side-by-side for supporting product deposited thereon.

30. The apparatus of claim 29 wherein selected ones of said top flight members are provided with pusher means for positively advancing product deposited thereon.

31. The apparatus of claim 30 wherein said pusher means are arranged at spaced predetermined intervals along the chain.

32. The apparatus of claim 31 wherein said intervals are of the order of fifteen inches.

33. The apparatus of claim 30 wherein said pusher means comprises members extending upwardly from the top surface of each of said top flight members to push product engaging said pusher means along said conveyor.

34. The apparatus of claim 29 wherein the top flight members each have a central portion which tapers to a narrower width at the opposite ends thereof to facilitate sidewise movement of said top flight members without obstruction when said closed-loop conveyor means traverses a curved configuration.

35. The apparatus of claim 29 further comprising guide blocks for guiding the top plates and drive chain along their respective conveying paths;

said top flight members having integral downwardly and outwardly extending projections which form a pair of channels for slidably engaging said guide blocks;

said drive chain being snap-fittingly received in a gap space between said downwardly depending projections.

36. The apparatus of claim 1 wherein the first section of said right lane conveyor has its downstream portion at a reduced height relative to its upstream portion;

the stacker receiving product from said right lane conveyor having conveyor means extending over said left lane conveyor in the region of the downstream end of said first section;

the height of said first section being chosen to provide sufficient clearance for the output conveyor of said stacker to enable operation of the output conveyor of said stacker and said left lane conveyor without obstruction.

37. Conveyor apparatus for conveying product produced from either a single delivery lane or a pair of delivery lanes arranged side-by-side to output utilization means, said conveyor system comprising:

left and right lane conveyor assemblies each having an upstream and a downstream end each for conveying product from one of said pair of delivery lanes;

support means for adjustably supporting the upstream ends of said left and right lane conveyors;

second support means for adjustably supporting the downstream end of said right lane conveyor;

said left lane conveyor being comprised of first and second conveyor sections arranged substantially end-to-end;

the upstream end of said first conveyor section being the upstream end of said left lane conveyor;

the downstream end of said first conveyor section being arranged adjacent the upstream end of said second conveyor section and the downstream end of said second conveyor section being arranged to convey product to said output utilization means;

the downstream end of said first section being hingedly connected to the upstream end of said second section to swingably adjust the upstream end of said first section to respectively receive product produced from one of said pair of delivery lanes when in the first position and product from said single delivery lane when in the second position;

the right lane conveyor being movable upon said first and second support means between a first position for receiving product from the remaining one of said pair of delivery lanes to a second position displaced from said first position and from said left lane conveyor to provide sufficient clearance to enable proper positioning of said left lane conveyor relative to said single delivery lane.

38. The apparatus of claim 37 wherein the centerlines of said pair of delivery lanes are arranged in spaced parallel fashion and the centerline of said single lane is parallel to and lies between the centerlines of said pair of lanes.

39. A method for operating a conveyor system for handling output from either a three-knife trimmer or a five-knife trimmer, said conveyor system comprising:

conveyor means for conveying product produced from either a three-knife trimmer or a five-knife trimmer to output utilization means, said conveyor system comprising:

left and right lane conveyor assemblies each having an upstream and a downstream end;

first support means for adjustably supporting the upstream ends of said left and right lane conveyors;

second support means for adjustably supporting the downstream end of said right lane conveyor;

said left lane conveyor being comprised of first and second conveyor sections movable relative to one another and being arranged substantially end-to-end;

the upstream end of said first conveyor section being the upstream end of said left lane conveyor;

the downstream end of said first conveyor section being arranged adjacent the upstream end of said second section and the downstream end of said second section being arranged to convey product to an output utilization means;

the downstream end of said first section being hingedly connected to the upstream end of said second section to enable swingable movement of the upstream end of said first section;

the right lane conveyor being movable upon said first and second support means; and means for releasably clamping the left and right lane conveyors to their associated support means, said method comprising the steps of:

releasing the releasable clamping means of said left and right lane conveyors;

laterally moving the right lane conveyor a predetermined distance so that the centerline at the upstream end is in alignment with the centerline of the right lane of product to be delivered thereto and moving the downstream end of said right lane conveyor laterally through a distance substantially equal to said predetermined distance;

swingably moving said first section about said hinge to adjust the upstream end of said first section so that its centerline is in alignment with the centerline of a left lane of product delivered thereto;

clamping said releasable clamping means to maintain the right lane and left lane conveyors in the desired position.

40. The method of claim 39 wherein drive means are provided for driving the left lane conveyor of said left lane and coupling means are coupled to the left lane driving means for driving said right lane conveyor means, said method further comprising the step of:

placing the coupling means between said left and right lane conveyors into an operating position to couple drive from said left lane conveyor to said right lane conveyor whereby the conveying speed of said right lane conveyor follows the conveying speed of said left lane conveyor.

41. The method of claim 40 further comprising the step of decoupling the coupling means to disable the right lane conveyor when operating to receive product from a three-knife trimmer.

42. A method for operating a conveyor system for handling output from either a three-knife trimmer or a five-knife trimmer, said conveyor system comprising:

conveyor means for conveying product produced from either a three-knife trimmer or a five-knife trimmer to output utilization means, said conveyor system comprising:

left and right lane conveyor assemblies each having an upstream and a downstream end;

first support means for adjustably supporting the upstream ends of said left and right lane conveyors;

second support means for adjustably supporting the downstream end of said right lane conveyor;

said left lane conveyor being comprised of first and second conveyor sections movable relative to one another and being arranged substantially end-to-end;

the upstream end of said first conveyor section being the upstream end of said left lane conveyor;

the downstream end of said first conveyor section being arranged adjacent the upstream end of said second section and the downstream end of said second section being arranged to convey product to an output utilization means;

the downstream end of said first section being hingedly connected to the upstream end of said second section to enable swingable movement of the upstream end of said first section;

the right lane conveyor being movable upon said first and second support means; and means for releasably clamping the left and right lane conveyors to their associated support means, said method comprising the steps of:

releasing the releasable clamping means;

moving the right lane conveyor laterally a predetermined distance so that the centerline at the upstream end thereof is displaced from the centerline of the right lane of product and moving the downstream end of said right lane conveyor laterally through a distance substantially equal to said predetermined distance;

swingably moving said first section about said hinge to adjust the upstream end of said section so that its centerline is in alignment with the centerline of product being conveyed from a three-knife trimmer; and clamping said releasable clamping means to maintain the right and left lane conveyors in the desired position.

43. The method of claim 42 wherein drive means are provided for driving the left lane conveyor of said left lane and coupling means are coupled to the left lane driving means for driving said right lane conveyor means, said method further comprising the step of:

decoupling the coupling means between said left and right lane conveyors to decouple drive from said left lane conveyor.

* * * * *

UNITED STATES PATENT AND TRADEMARK OFFICE

CERTIFICATE OF CORRECTION

PATENT NO. : 5,238,240

DATED : AUGUST 24, 1993

INVENTOR(S) : JOHN E. PRIM - DAVID HALL

It is certified that error appears in the above-indentified patent and that said Letters Patent is hereby corrected as shown below:

Column 3, line 47, change "31" to read --31--

Column 4, line 47, change "30" to read --3o--

Column 6, line 12, after "left" insert --lane conveyor 32 and preferably being tensioned in--

Column 7, line 15, change "31" to read --31--

Column 7, line 58, change "72" (second occurrence) to read --72′--

Column 9, line 34, change "right" to read --left--

Column 11, line 14, before "disengaging" insert --for--

Signed and Sealed this

Thirtieth Day of August, 1994

*Attest:*

*Attesting Officer*

Bruce Lehman

BRUCE LEHMAN

*Commissioner of Patents and Trademarks*